US005372769A

United States Patent [19]

Ryberg

[11] Patent Number: 5,372,769

[45] Date of Patent: Dec. 13, 1994

[54] METHOD OF PRODUCING CONCRETE ELEMENTS

[75] Inventor: Nils Ryberg, Kolbäck, Sweden

[73] Assignee: CBT, Concrete Building Technology AB, Kolbäck, Sweden

[21] Appl. No.: 39,388

[22] PCT Filed: Oct. 24, 1991

[86] PCT No.: PCT/SE91/00715

§ 371 Date: Apr. 21, 1993

§ 102(e) Date: Apr. 21, 1993

[87] PCT Pub. No.: WO92/07695

PCT Pub. Date: May 14, 1992

[30] Foreign Application Priority Data

Oct. 24, 1990 [SE] Sweden ..... 9003400

[51] Int. Cl.[5] ..... B28B 1/16

[52] U.S. Cl. ..... 264/254; 264/256; 264/265; 264/275; 264/277; 264/279.1

[58] Field of Search ..... 264/277, 279, 279.1, 264/333, 256, 69, 254, 274, 31, 275, 265

[56] References Cited

U.S. PATENT DOCUMENTS

| | | | |
|---|---|---|---|
| 841,749 | 1/1907 | Wells et al. | 264/279 |
| 862,440 | 8/1907 | Bradford | 204/273 |
| 2,443,961 | 6/1948 | Pelatowski | 264/279 X |
| 3,653,170 | 4/1972 | Scheckler | 264/333 X |
| 4,141,946 | 2/1979 | Rauenhorst | 264/256 X |
| 4,186,536 | 2/1980 | Piazza | 264/279 X |
| 4,280,974 | 7/1981 | Piazza | 264/69 |
| 4,318,258 | 3/1982 | Heck | 52/309 |
| 4,394,201 | 7/1983 | Haeussler | 264/274 X |
| 4,479,916 | 10/1984 | Blatchford | 264/263 |
| 4,548,007 | 10/1985 | Newman | 264/256 X |
| 4,841,702 | 6/1989 | Huettemann | 52/309 |
| 5,186,883 | 2/1993 | Beall, III | 264/279.1 X |

FOREIGN PATENT DOCUMENTS

| | | | |
|---|---|---|---|
| 0063559 | 10/1982 | European Pat. Off. | 264/279.1 |
| 2209319 | 6/1974 | France | 264/256 |
| 2256808 | 8/1975 | France | 264/256 |
| 455517 | 2/1928 | Germany | 264/256 |
| 1962529 | 7/1971 | Germany . | |
| 2302172 | 7/1974 | Germany . | |
| 2341901 | 3/1975 | Germany . | |
| 2711198 | 9/1978 | Germany . | |
| 3203156 | 11/1982 | Germany | 264/279 |
| 8401402 | 4/1984 | WIPO | 264/256 |

*Primary Examiner*—Karen Aftergut

*Attorney, Agent, or Firm*—Bergert & Tamburro Nies, Kurz

[57] ABSTRACT

A method of producing slab-like concrete elements having mutually parallel sides and containing one or more filling bodies wherein a part of the element which contains one or more filling bodies is cast in a first manufacturing stage and allowed to harden, and wherein the hardened part is turned upside down and lowered into a mould which contains fresh concrete, in a second manufacturing stage and the fresh concrete is allowed to harden. In the first manufacturing stage the concrete is poured into the mould to a level such that the upwardly facing side of each filling body will be free from concrete; in that the free surface of each filling body has provided therein recesses whose combined volumes correspond to the variation in the amount of concrete used in the second manufacturing stage; and in that in the second manufacturing stage the first part is lowered into the mould containing fresh concrete to a level at which the produced concrete element has a nominal thickness.

7 Claims, 1 Drawing Sheet

METHOD OF PRODUCING CONCRETE ELEMENTS

The present invention relates to a method of producing concrete elements, and more specifically to a method of producing slab-shaped concrete elements which are intended to form or to be a part of a structural member in wall or floor structures.

Such concrete elements have long been known. The elements normally comprise a slab-like body having planar sides and being of uniform thickness and provided with filling bodies. The elements are normally manufactured by pouring concrete into a horizontal mould or form, wherein a part of the element which contains one or more filling bodies is cast in a first manufacturing stage. Subsequent to solidification of this first part of the concrete element, it is turned upside down and lowered into a mould which contains fresh concrete, whereafter the fresh concrete is caused to harden. The volume of fresh concrete poured into the mould corresponds to the desired thickness of the concrete element. The concrete poured into the mould is vibrated and then allowed to harden.

One very serious problem with such manufacturing methods is the difficulty found in achieving uniform qualities with regard to the thickness of the concrete elements produced. This difficulty is caused by the difficulty of controlling delivery of the concrete to the mould, such that the mould is filled with the same amount of concrete on each occasion. Because of these variations in the thickness of the cast concrete elements, it is necessary to smooth and level the surface of the wall or floor constructed from said elements with filler, etc.

This problem is solved by means of the present invention, which provides a technique in which concrete elements of precisely the same thicknesses are obtained.

The present invention thus relates to a method of manufacturing slablike concrete elements having mutually parallel sides and containing one or more filling bodies, wherein the part of the element which contains the one or more filling bodies is cast in a first manufacturing stage and allowed to harden, and wherein said hardened part is turned upside down and lowered into a mould which contains fresh concrete in a second manufacturing stage and the fresh concrete is allowed to harden. The method is characterized in that in the first manufacturing stage the concrete is poured into the mould to a level such that the upwardly facing side of each filling body will be free from concrete; in that the free surface of each filling body has provided therein recesses whose combined volumes corresponds to the variation which occurs in the amount of concrete poured in the second manufacturing stage; and wherein in the second manufacturing stage said first part is lowered into the mould to a level at which the element has a nominal thickness.

Figure 1:
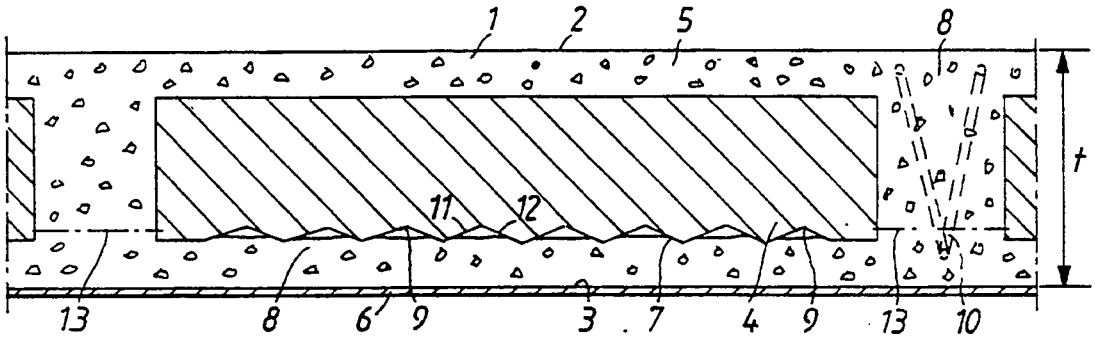
Figure 2:
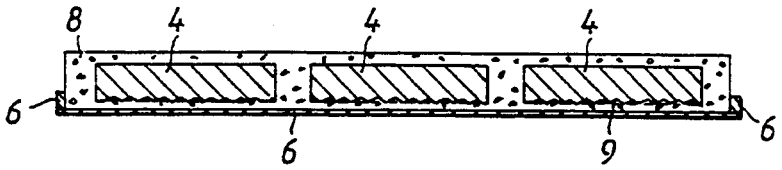

The invention will now be described in more detail with reference to an exemplifying embodiment thereof and with reference to the accompanying drawing, in which FIG. 1 is a cross-sectional view of a portion of a concrete element during its manufacture; and FIG. 2 is a cross-sectional view of a concrete element shown by way of example.

FIG. 1 is a cross-sectional view of part of a concrete element shown in FIG. 2. The finalized concrete element 1 has the form of a slab, having two mutually parallel upper and lower sides 2, 3 and containing one or more filling bodies 4. A part of the element which contains one or more filling bodies is cast in a first stage of the manufacture of the concrete element, this concrete element part being the upper part 5 shown in FIG. 1. During this first stage casting process, the side 2 forms the lower surface and concrete is poured into a mould to a level shown by the chain (phantom) lines 13, for instance. Subsequent to having hardened, this first part 5 of the concrete element is turned upside down to the position shown in FIG. 1 and is lowered into a second stage mould containing fresh concrete, whereafter the fresh concrete is allowed to harden. The complete second stage mould 6 is shown in FIG. 2.

According to the invention, in the first stage of manufacture the concrete is poured into the mould to a level at which the upwardly facing side 7 of each filling body will be free from concrete 8. This upwardly facing side or free surface 7 of each filling body has formed therein recesses 9, in accordance with the invention. The combined volume of the recesses 9 corresponds to the variation which can occur in the amount of additional concrete used when casting in the second stage of element manufacture. According to the invention, the first part 5 is inverted and lowered into the second stage mould 6, containing fresh concrete in the second manufacturing stage, to a level at which the concrete element has a desired nominal thickness t.

A typical thickness t of the concrete element is. e.g., 26 cm, and the filling body 4 may have a thickness of 16 cm.

The concrete element will normally be reinforced, as indicated by the dotted lines 10 in FIG. 1.

According to one preferred embodiment of the invention, the volume of the recesses corresponds to about 10 percent of the nominal amount of fresh concrete used in the second stage of casting. Under normal conditions, this will ensure that a mould can be filled with a given nominal amount of concrete ±5 percent of the nominal amount, with a high degree of reproduceability. FIG. 1 illustrates the case where the mould bag been filled with a nominal amount of concrete and where the concrete takes up roughly half the volume of the recesses 9. Because the thickness of the concrete element is adjusted to the nominal thickness t, when the amount of concrete poured in to the mould is smaller than the nominal amount, the concrete will take up less than half of the volume of the recesses, whereas when the amount of concrete poured into the mould is greater than the nominal amount, the recesses will be filled to more than half their volume.

It is therefore obvious that the recesses function to equalize variations in the amount of concrete poured into the mould during the second stage of manufacture, so that a concrete element of nominal thickness will always be obtained.

According to one preferred embodiment, the recesses 9 extend over the full length or width of the filling body 4, such that each recess will open out on at least one side of the filling body. This ensures that the concrete will be readily distributed evenly in the recesses. The recesses 9 preferably have the form of mutually parallel dales or troughs, which preferably have planar sides 11, 12.

According to one preferred embodiment of the invention, the bottom angle of the recesses, i.e. the angle defined by the sides 11, 12, is about from 90 to 150 degrees.

The depth of the recesses is about 10 to 25 percent of the thickness of the filling body.

The filling bodies 4 may be formed from any suitable material, but according to one preferred embodiment of the invention are formed from a cellular plastic material. Such material is both heat and sound insulating and can be readily worked mechanically.

It is evident that the invention solves the problem described in the introduction.

Although the invention has been described in the aforegoing with reference to only one particular element, it will be understood that the invention can be applied in the manufacture of all slab-like elements having two mutually parallel sides and containing one or more filling bodies. The construction of the element and the form of the filling bodies can therefore be varied.

The invention shall not therefore be considered restricted to the described and illustrated embodiment, since variations and modifications can be made within the scope of the following claims.

I claim:

1. A method of manufacturing a slab-form concrete element having a predetermined nominal thickness between mutually parallel upper and lower sides and containing at least one essentially flat filling body with a thickness, wherein a first part, of the element, which contains said at least one filling body is cast, in a first mould, in a first manufacturing stage and allowed to harden, and wherein said first part, when hardened, is turned upside down and lowered into a second mould, which contains an amount of fresh concrete, in a second manufacturing stage and the fresh concrete is allowed to harden, the improvement in the method comprising: in the first manufacturing stage, pouring a first quantity of concrete into the first mould, after said at least one filling body is placed in the first mould to a level such that an upwardly facing side of said at least one filling body, when in said first mould, is above and free from said first quantity of concrete and permitting said first quantity of concrete, which includes said at least one filling body, to harden to thereby become the first part of the concrete element, wherein said upwardly facing side of said at least one filling body is provided with recesses whose combined volumes of space corresponds to a variation in the amount of fresh concrete used in the second manufacturing stage such that the recesses accommodate the variation in the amount of fresh concrete in the second mould to provide the concrete element with the predetermined nominal thickness; and including in the second manufacturing stage, the steps, after the first quantity of concrete has hardened, of inverting and lowering said first part, into the second mould containing the fresh concrete, to a level at which the concrete element is formed with the predetermined nominal thickness between its upper and lower sides due to the recesses provided on the at least one filling body accommodating the variation in the amount of fresh concrete used in the second manufacturing stage.

2. A method according to claim 1, wherein the recesses are made to extend across said upwardly facing side of said at least one filling body, such that each recess opens out on at least one side edge of the filling body.

3. A method according to claim 1, wherein the combined volumes of space of the recesses is made to correspond to about 10 percent of the amount of said fresh concrete contained in said second mould.

4. A method according to claim 1, wherein the recesses are shaped as mutually parallel dales having a depth, which dales have planar side walls.

5. A method according to claim 4, wherein said dales are made with converging side walls resulting in an angle at a bottom of each of the recesses, which angle is within a range of from about 90 to about 150 degrees.

6. A method according to claim 1, wherein a depth of the recesses is in a range of about 10 to 25 percent of the thickness of said at least one filling body.

7. A method according to claim 1, wherein said at least one filling body is made from a cellular plastic material.

* * * * *